US005922433A

United States Patent [19]

Scherbel

[11] Patent Number: 5,922,433

[45] Date of Patent: Jul. 13, 1999

[54] ELASTIC INTERLINING

[75] Inventor: Ulrich Scherbel, Vaterstetten, Germany

[73] Assignee: Kufner Textilwerke GmbH, München, Germany

[21] Appl. No.: 08/800,187

[22] Filed: Feb. 13, 1997

[30] Foreign Application Priority Data

Oct. 23, 1996 [DE] Germany ..... 196 44 111

[51] Int. Cl.[6] ..... B32B 33/00

[52] U.S. Cl. ..... 428/91; 428/95; 428/96; 156/60

[58] Field of Search ..... 442/168, 214, 442/215, 216, 217, 314; 428/91, 95, 96; 156/60

[56] References Cited

U.S. PATENT DOCUMENTS

| | | | |
|---|---|---|---|
| 4,696,850 | 9/1987 | Jost et al. | 428/197 |
| 5,075,151 | 12/1991 | Kufner et al. | 428/198 |
| 5,102,724 | 4/1992 | Okawahara et al. | 428/224 |
| 5,153,049 | 10/1992 | Groshens | 428/196 |
| 5,194,320 | 3/1993 | Groshens | 428/230 |
| 5,241,709 | 9/1993 | Kufner et al. | 2/97 |
| 5,294,479 | 3/1994 | Longo | 428/236 |
| 5,552,206 | 9/1996 | Knoke et al. | 428/102 |

FOREIGN PATENT DOCUMENTS

| | | |
|---|---|---|
| 0 289 378 | 11/1988 | European Pat. Off. . |
| 41 16 569 | 11/1992 | Germany . |
| 94 17 827 | 1/1995 | Germany . |
| PS-44 08 813 | 10/1995 | Germany . |

*Primary Examiner*—Christopher Raimund
*Attorney, Agent, or Firm*—Scully, Scott, Murphy & Presser

[57] ABSTRACT

This invention relates to an elastic interlining, particularly an elastic setting interlining, which contains a napped base material and a layer mounted thereon and composed of an adhesive, whereby the base material contains multicomponent fibers constructed from at least two different polymers. Polyester-based bicomponent fibers are preferably used, whereby these yarns can also be mixed with polyester, polyamide, polyacrylonitrile, viscose, wool or cotton. Such an interlining can be used as an elastic setting interlining for reinforcing face fabrics, particularly for reinforcing the front portion of garments.

11 Claims, No Drawings

ELASTIC INTERLINING

The present invention relates to an interlining, particularly an elastic setting interlining, comprising a base material and a layer mounted thereon made of an adhesive, preferably a hot-melt adhesive compound.

Such interlinings have been used for a great many years in the clothing industry, particularly to reinforce the front portion of garments. These interlinings consist of a base material, which may be designed as a woven fabric, knitted fabric or as a nonwoven fabric, and of a usually thermoplastic adhesive applied in the form of a raster, whereby this adhesive makes it possible to bond with the face fabric of the garments.

Such interlinings have the object of shaping and stabilizing the garment in a fully fashioned manner. Since they are bonded with the face fabric, they decisively affect the character of the finished garment. The look, shape retention property, softness, wear comfort and easy-care properties during cleaning and washing crucially depend on the type and structure of the interlining used. The visual appearance, feel and easy-care behavior of the finished garment are particularly important properties of items of apparel.

The garments also have to comply with changing fashions. In consequence, a wide range of different face fabrics is used. As a rule, various types of interlining are therefore likewise used to reinforce these different face fabrics.

Staple fiber yarns composed of viscose (CV), cotton (CO), polyester (PES), polyacrylonitrile (PAN) and mixtures thereof are usually used for conventional interlinings based on woven fabrics. In practice, the fineness of the yarns used vary between 10 and 200 Nm. The weight of these interlinings usually ranges from 35 to 140 g/m$^2$. The woven fabrics produced in this manner are either cross-linked by cellulose cross-linkers or are thermally shrink-stabilized. Napping or abrading one side of the fabric produces as dense a fiber web as possible on the interlining's surface, thus achieving considerable softness, volume and densely woven character of the interlining. This aspect is vitally important to the feel of the finished item. The unnapped woven-fabric side is then coated according to known techniques with an adhesive, preferably hot-melt adhesives. When the interlining is bonded with the face fabric, the fiber web on the reverse also prevents the hot-melt adhesive from penetrating the interlining toward the side of the lining fabric.

Similar interlinings are also known as knitted fabrics. The aforementioned staple fiber yarns made of CV, CO, PES, PAN and mixtures thereof are used in the weft. As a rule, the warp is formed from fine filament yarns which preferably consist of PES or polyamide (PA) and have a fineness ranging from 25 dtex to 78 dtex. The side that is not coated with hot-melt adhesive is again napped here as well in order to achieve a soft feel and high volume and to prevent the coating from breaking through the interlining.

Nonwoven fabrics are also used as base materials for interlinings. The weight of such interlinings, which are used for the front-setting of garments, usually ranges from 30 to 80 g/m$^2$. As a rule, they are solidified thermally by screen-engravedcalender rolls. The nonwoven fabrics are frequently also reinforced by warp and/or weft yarns which can be knitted in. These threads likewise comprise the above fine filament yarns or comprise textured polyester filaments. These nonwoven fabrics can be coated with hot-melt adhesives. Normally, the risk that the coating will break through the face fabric is slight as a result of the nonwoven character. But in any case it is a disadvantage for this type of interlining not to obtain the volume and soft feel of the above-cited napped interlinings.

What is common to all the aforementioned interlinings, however, is that with regard to tensile stresses, these interlinings are largely rigid and not very elastic in a longitudinal and transverse direction. A slight extensibility of the interlining is possible under high mechanical stress. This extension is, however, only incompletely reformed after the application of load. This lack of elasticity exhibited by the known interlinings represents a serious disadvantage.

If such a known interlining is bonded with an face fabric, the interlining is unable to follow the face fabric's dimensional change due to heat, during washing, due to solvents during cleaning or due to external forces, which may result in the formation of creases, causing the interlining partly to come off or even producing wavy deformations and dents. This substantially impairs the garment's useful life.

If, while the interlining is being set with the face fabric, it is now attempted to avoid such separations and to enhance adhesion by applying a larger quantity of adhesive, the adhesive may penetrate through the interlining and/or face fabric. As a result, not only is the setting press of the manufacturer of ready-made clothes contaminated and the smooth setting sequence disrupted by blank parts adhering to one another, but the feel and hence the commodity value of these garments is also considerably impaired.

Since the amount of adhesive applied cannot be increased for this reason, it was attempted to adapt the interlining, with regard to its shrink behavior, to the respective face fabric. Yet this approach is virtually impossible in terms of the clothing industry's practice, as a great many different face fabrics with extremely varying properties are fabricated and because the clothing industry is, however, compelled, for reasons of economy, to cover the entire range of face fabrics with as few varieties of interlining type as possible. No satisfactory setting result can be achieved either using this type of rigid interlining on elastic face fabrics, since the properties of interlining and face fabric differ too greatly.

To avoid these disadvantages, another type of setting interlining was developed over recent years. These interlinings are characterized by the use of textured polyester filament yarns with a fineness of 20 to 400 dtex as weft threads. The warp may be constructed in a manner similar to that already indicated above in the known rigid interlinings, but it may also be produced from textured polyester yarns with a fineness ranging from 25 to about 167 dtex. The woven or knitted base material is in turn coated with hot-melt adhesives according to known techniques. The weight of these interlinings is usually between 35 and 120 g/m$^2$.

The properties of the setting interlinings are shaped to a decisive extent by the properties of the textured polyester filament yarns. These textured polyester filament yarns are elastic to a considerable degree because they extend very easily when exposed to tensile stresses in the warp and weft directions just as in slanting-off. Once the tensile stress has finished, these yarns return virtually to their original state. Elasticity in the weft direction is usually 20–25%, but may amount to as much as 40%. Elasticity in the warp direction is ideally 6–8%. Elasticity values of up to 15% are also known, but in the case of fabrication in the clothing industry, greater input is required to achieve this high elasticity value.

This interlining's elasticity enables it to comply exactly with the face fabric's dimensional change due to heat, during washing, due to solvents during cleaning or due to external forces. The rigid napped interlining's above-identified disadvantages are avoided in consequence. This type of interlining—especially when these interlinings comprise textured polyester yarns in terms of warp and weft—therefore has an almost multipurpose use on a great many different face fabrics.

Crimping the textured polyester yarns also produces a high volume that prevents the hot-melt adhesive, when being set with the face fabric, from folding back through the interlining toward the side of the lining fabric.

Yet a disadvantage of this type of interlining is that the textured polyester filament yarns cannot be napped without the filaments being destroyed.

The interlining's resultant feel therefore cannot achieve the soft feel and elegance of a rigid napped interlining.

Gradual changes were obtained by using textured microfiber yarns that are intended to enable a softer feel as a result of the individual filament's fineness. Complex structures are also known for example from EP-A-O 289 378; in addition to warp and weft, which each comprise textured polyester yarns, such structures introduce a third fiber system composed of nappable non-elastic yarns, as are also used in classic napped interlinings. But the fabric appearance of a rigid napped interlining is not achieved as a result, since the basic problem still remains that the elastic fiber systems still cannot be napped.

For this reason, the resultant feel of these elastic setting interlinings and the finished garment is judged to be too synthetic, dry and artificial when compared with classic napped interlinings, particularly as regards the top-of-the-range fashion industry.

The object of the present invention is therefore to develop an interlining of the aforementioned type which avoids the disadvantages of the hitherto known interlining types; in other words an interlining that possesses the advantageous resultant feel and elegance of a rigid napped interlining, yet which at the same time is elastic, flexible and virtually multipurpose.

Surprisingly, it was possible to solve this problem by using multicomponent fibers, particularly bicomponent fibers, as a base material for the interlining. The multicomponent fibers are constructed from at least two different polymers. The use of these multicomponent fibers makes it possible to produce an elastic interlining which can, however, also be easily napped at the same time.

Bicomponent fibers consisting of two different polymers are preferably used as multicomponent fibers. Polymers based on polyester, polyamide or polyacrylonitrile can be used for the multicomponent fibers. The different buildup of the various polymer components causes the fiber to be crimped in a three-dimensional manner, which fundamentally differs from the mechanical crimping achieved by texturing. The features of crimping can be influenced by altering the thermal shrinking property of the two components and/or the quantitative ratio of the polymer components used for producing the multicomponent fiber. According to the invention, a polyester-based bicomponent fiber is preferably used, with the polyester polymers being constructed on the basis of two different diols. These bicomponent fibers have a bilateral structure, the components being arranged side by side in a ratio of 50:50. Such fibers are e.g. available under the trade name TERGAL X 403 (manufactured by Rhône-Pulenc Textile).

The multicomponent fibers preferably have a fiber length of 15 to 400 mm, preferably 35 to 200 mm. The fineness of the used individual fiber titers varies between 0.5 and 12 dtex, but it is preferably about 6 to 8 dtex. A particularly preferred value for the fineness is 6.7 dtex. The finenesses of the staple fiber yarns according to the invention and which comprise these multicomponent fibers range from 6 to 200 Nm, though more preferably ranging from 16 to 32 Nm.

Much better crimping values are achieved by using staple fiber yarns composed of multicomponent fibers than was the case when textured filament yarns composed of standard polyester were used. As set out below, the better crimping values are illustrated by comparing a polyester-based bicomponent fiber with a textured polyester fiber:

| | Bicomponent fiber Tergal X 403 | Standard polyester |
|---|---|---|
| Crimping | 35%–37% | 24%–25% |
| Residual crimping | 28%–30% | 16%–18% |
| Crimp resistance | 80% | 60% |

On grounds of costs, these multicomponent fibers can be mixed with other fibers during the production of yarn. Wool, viscose or cotton threads are preferably used for this purpose. It is also possible to use a mixture of multicomponent fibers for example with polyester, polyamide, polyacrylonitrile optionally together with the above-mentioned viscose, wool or cotton threads. In this instance, the proportion of multicomponent fibers in the mixture is preferably at least 50% if extension values of more than 15% are to be achieved in the finished product.

The base material of the elastic interlining according to the invention may be produced such that the warp and weft threads consist of the multicomponent fibers, optionally admixed with the above polyester, polyamide, polyacrylonitrile, viscose, wool and cotton fibers, but in addition to these multicomponent fibers, it is possible to use textured or even non-textured staple fiber yarns. In this case, it is possible to use the multicomponent fibers for the weft threads, optionally admixed with the above materials, and to use textured or even non-textured threads, e.g. based on polyester or polyamide, for the warp threads.

Woven or knitted fabrics or even nonwoven fabrics, which are mono- or bi-elastic, can be produced by using the multicomponent fibers.

The interlinings obtained in this way can now be napped on one side according to prevalent techniques. A hot-melt adhesive is likewise applied to the other side of this interlining according to the usual techniques, preferably in the form of a dot screen. The interlining according to the invention makes it possible to combine the resultant feel of a napped interlining and the advantageous stretch properties of elastic interlinings in a single product. It is therefore possible to use the interlining according to the invention in order to set a wide variety of types of face fabrics, with this interlining being capable of satisfying any dimensional changes exhibited by the face fabric. Deformations or dents are consequently no longer produced and the interlining is not even caused to come off.

If a knitted interlining is produced, it is also possible to introduce a further fiber system as standing threads. The resultant interlining is likewise very elastic because the multicomponent fibers are used according to this invention.

Of course it is also possible for threads composed of bicomponent fibers and conventional threads to occur alternately within the weft. By using the bicomponent fibers, the resultant interlining is very elastic.

It is equally possible to knit a nonwoven fabric into the base material which contains the multicomponent fibers. By using multicomponent fibers, the nonwoven fabric's advantages, as mentioned at the outset, can in consequence be combined with the elastic properties.

By way of example, particularly preferred embodiments will be presented in the following so as to explain this invention in more detail.

EXAMPLE 1 Double-stretch Interlining (woven fabric)

| | |
|---|---|
| Warp: | 1600 threads, 60% PES bicomponent fiber/ 40% viscose Nm 32/1 |
| Weft: | 60% PES bicomponent fiber/40% viscose 32/1 Nm |
| Weft density: | 120 |
| Napping: | 8 passes |
| Coating: | 12 g/m$^2$ polyamide hot-melt adhesive |
| Finished weight: | app 95 g/m$^2$ |

By using PES bicomponent yarns in the warp and PES bicomponent yarns in the weft, the article obtained is elastic in the warp and weft direction, with both warp and weft being napped. An optimum soft feel is achieved as a result.

EXAMPLE 2 Double-stretch Interlining (woven fabric)

| | |
|---|---|
| Warp: | 4008 threads, PES filament, textured, dtex 78/1 f32 |
| Weft: | 60% PES bicomponent fiber/40% viscose 32/1 |
| Weft density: | 120 |
| Napping: | 8 passes |
| Coating: | 12 g/m$^2$ polyamide hot-melt adhesive |
| Finished weight: | app 84 g/m$^2$ |

By using textured PES filament yarns in the warp and PES bicomponent yarns in the weft, the article obtained is elastic in the warp and weft directions, with the weft being napped. This article represents a compromise between soft feel and inexpensive price.

EXAMPLE 3 Mono-stretch Interlining (woven fabric), Elastic In The Weft

| | |
|---|---|
| Weft: | 5420 threads, PES smooth normal type/viscose 50%/50% Nm 60/1 |
| Weft: | 60% PES bicomponent fiber/40% viscose Nm 32/1 |
| Weft density: | 105 |
| Napping: | 8 passes |
| Coating: | 12 g/m$^2$ polyamide hot-melt adhesive |
| Finished weight: | app. 88 g/m$^2$ |

By using conventional, rigid PES/CV yarns in the warp and PES bicomponent yarns in the weft, the article obtained is elastic in the weft direction, with warp and weft being napped. This article enables a very soft feel and is mono-elastic.

EXAMPLE 4 Mono-stretch Interlining (knitted fabric), Elastic In The Weft

| | |
|---|---|
| Warp: | 2008 threads, polyamide filament, smooth, dtex 44f13 |
| Machine fineness: | E24 |
| Weft: | 60% PES bicomponent fiber/40% viscose Nm 32/1 |
| Weft density: | 120 |
| Napping: | 8 passes |
| Coating: | 12 g/m$^2$ polyamide hot-melt adhesive |
| Finished weight: | app. 89 g/m$^2$ |

By using conventional, rigid PA yarns in the warp and PES bicomponent yarns in the weft, the article obtained is elastic in the weft direction, with the weft being napped. The napped weft yarn's impression of feel does, however, dominate as a result of the fine warp yarn and the coarse weft yarn. This article enables a soft feel and is mono-elastic.

I claim:

1. An elastic interlining comprising a napped base material, said base material being a woven fabric or a knitted fabric comprising multicomponent fibers having fiber lengths of between 15 mm and 400 mm constructed of at least two polymers and an adhesive layer disposed on the unnapped surface with the proviso that said interlining has a weight in the range of 35 g/m$^2$ to 140 g/m$^2$.

2. An elastic interlining according to claim 1, wherein said multicomponent fibers are bicomponent fibers constructed from two different polymers based on polyester, polyamide or polyacrylonitrile or mixtures thereof.

3. An elastic interlining according to claim 1, wherein a titer of individual fibers of said multicomponent fibers ranges from 0.5 to 12 dtex.

4. An elastic interlining according to claim 1, wherein said multicomponent fibers are p resent in a mixture with fibers composed of polyester, polyamide, polyacrylonitrile, viscose, cotton or wool.

5. An interlining according to claim 1 wherein said base material additionally comprises textured or non-textured staple fiber yarns composed of polyester, polyacrylonitrile, polyamide, viscose, cotton, wool or mixtures thereof.

6. An elastic interlining according to claim 1, wherein said base material is a woven fabric, the warp and weft threads of which comprise polyester-based multicomponent fibers, optionally mixed with polyester, polyamide, polyacrylonitrile, viscose, wool or cotton.

7. An elastic interlining according to claim 1, wherein said base material is a woven fabric, the warp threads of which comprise textured or non-textured polyester yarns and the weft threads of which comprise polyester-based multicomponent fibers, optionally mixed with polyester, polyamide, polyacrylonitrile, viscose, wool or cotton.

8. An elastic interlining according to claim 1, wherein said base material is a knitted fabric comprising warp and weft threads, the warp threads of which comprise polyamide filaments or polyester filaments that are textured or non-textured, and the weft threads of which comprise polyester-based multicomponent fibers, optionally mixed with polyester, polyamide, polyacrylonitrile, viscose, wool or cotton.

9. An elastic interlining according to claim 1 wherein the base material comprises warp and weft threads the weft threads of said base material comprises threads of said multicomponent fibers admixed with threads of textured or non-textured staple fiber yarns.

10. A method of reinforcing face fabrics comprising attaching said elastic interlining of claim 1 to a face fabric.

11. A method of reinforcing garments comprising attaching said elastic interlining of claim 1 to the front portion of a garment.

* * * * *